US011969110B2

(12) United States Patent
Streets

(10) Patent No.: US 11,969,110 B2
(45) Date of Patent: Apr. 30, 2024

(54) REPOSITIONABLE CLOSET BAR

(71) Applicant: Jeffrey Lowell Streets, Cypress, TX (US)

(72) Inventor: Jeffrey Lowell Streets, Cypress, TX (US)

(73) Assignee: Closet Toolz Corporation, Cypress, TX (US)

( * ) Notice: Subject to any disclaimer, the term of this patent is extended or adjusted under 35 U.S.C. 154(b) by 0 days.

(21) Appl. No.: 18/092,333

(22) Filed: Jan. 1, 2023

(65) Prior Publication Data

US 2023/0145842 A1 May 11, 2023

Related U.S. Application Data

(63) Continuation-in-part of application No. 17/705,348, filed on Mar. 27, 2022, now Pat. No. 11,571,064, which is a continuation-in-part of application No. 17/239,642, filed on Apr. 25, 2021, now Pat. No. 11,350,742.

(51) Int. Cl.

| | |
|---|---|
| ***A47G 25/06*** | (2006.01) |
| ***A47B 61/02*** | (2006.01) |
| *A47B 61/00* | (2006.01) |

(52) U.S. Cl.

CPC ..... *A47G 25/0685* (2013.01); *A47B 61/02* (2013.01); *A47G 25/0692* (2013.01); *A47B 61/003* (2013.01)

(58) Field of Classification Search

CPC ..... A47G 25/0685; A47G 25/0692; A47G 25/28; A47G 25/1457; A47G 25/145; A47G 25/02; A47G 25/276; A47G 25/74; A47G 25/4053; A47G 25/44; A47G 25/743; A47G 25/14; A47B 61/02; A47B 61/003; A47B 96/067; A47B 96/14; A47B 96/1408; A47F 5/00; A47F 5/0006; A47F 5/0807; A47F 5/0838; A47F 7/00; A47F 7/12; A47F 7/19; B60R 7/10

See application file for complete search history.

(56) References Cited

U.S. PATENT DOCUMENTS 1,375,611 A * 4/1921 Schoell ..... B60R 7/10 211/7
1,415,316 A * 5/1922 Corbin ..... A47B 61/02 211/85.3

(Continued)

*Primary Examiner* — Devin K Barnett

(57) ABSTRACT

A repositionable closet bar for hanging clothes includes an elongate rigid bar having a distal section, a proximal section, an intermediate section between the distal section and the proximal section, and a downward-directed seat. The elongate rigid bar is formed with molded walls forming upward-facing walls and side walls that are reinforced by ribs connecting the walls. The elongate rigid bar is configured to be positioned between a closet shelf and a closet rod, repositioned side-to-side between the closet shelf and rod and repositioned in a forward or rearward direction between the closet shelf and rod. When in use, no portion of the bar is fastened to the closet shelf or the closet rod. The downward-directed seat is configured to engage an upward-facing surface of the closet rod when the flat upward-facing wall of the distal section engages the bottom surface of the closet shelf.

18 Claims, 8 Drawing Sheets

(56) References Cited

U.S. PATENT DOCUMENTS 1,639,021 A * 8/1927 Batts ..... A47B 61/003 211/175
1,674,758 A * 6/1928 Batts ..... A47B 61/02 211/85.3
1,695,517 A * 12/1928 Waldbauer ..... E05B 69/006 211/124
1,854,393 A * 4/1932 Berg ..... A47B 61/02 248/294.1
2,045,942 A * 6/1936 Brody ..... F16B 12/40 211/182
2,661,850 A * 12/1953 Fowler ..... A47H 1/022 211/105.4
2,908,471 A * 10/1959 Hollansworth ..... A47B 96/027 108/29
2,917,185 A * 12/1959 Kovacs ..... A47G 25/746 211/94.01
2,985,311 A * 5/1961 Abel ..... A47G 25/746 211/85.3
3,032,273 A * 5/1962 Spielman ..... A47G 25/0685 239/57
3,116,837 A * 1/1964 Kelly ..... A47B 61/02 211/94.01
3,148,808 A * 9/1964 Griffin ..... A47G 25/60 223/86
3,282,548 A * 11/1966 Ruhnke ..... A47B 61/003 256/65.16
3,286,850 A * 11/1966 Ruhnke ..... A47B 61/003 256/65.16
3,335,872 A * 8/1967 Dodich ..... A47G 25/746 211/85.3
3,389,807 A * 6/1968 Manning ..... A47B 61/003 211/85.3
3,424,314 A * 1/1969 Cornelsen ..... B60R 7/10 248/323
3,518,421 A * 6/1970 Cogdill ..... F21V 21/02 248/248
3,784,023 A * 1/1974 Varon ..... A47F 7/24 211/105.1
3,897,122 A * 7/1975 McEvers ..... A47G 25/746 211/85.3
3,954,182 A * 5/1976 McEvers ..... A47G 25/746 211/94.01
4,104,972 A * 8/1978 Baublitz ..... A47B 61/02 211/85.3
4,105,127 A * 8/1978 Holl ..... G09F 7/18 211/124
4,108,315 A * 8/1978 Inao ..... D06F 57/00 211/124
4,111,309 A * 9/1978 Henry ..... A47B 61/02 211/180
4,139,102 A * 2/1979 Winton ..... E05B 69/006 211/124
4,316,547 A * 2/1982 Varon ..... A47G 25/0692 211/124
4,407,476 A * 10/1983 Bohannan ..... A47B 96/021 211/90.01
4,427,119 A * 1/1984 Savino ..... A47G 25/746 211/94.01
D273,645 S * 5/1984 McEvers ..... D6/513
4,474,299 A * 10/1984 Andrews ..... A47F 7/24 211/193
4,488,651 A * 12/1984 Bishop ..... A47K 3/38 211/105.6
D277,248 S * 1/1985 Benedict ..... D6/324
D277,436 S * 2/1985 Benedict ..... D6/315
D280,575 S * 9/1985 Benedict ..... D6/315
D280,785 S * 10/1985 Benedict ..... D6/315
4,585,127 A * 4/1986 Benedict ..... A47B 61/02 211/94.01
4,593,839 A * 6/1986 Vandoros ..... A47G 25/446 223/63
4,643,318 A * 2/1987 Kopp ..... A47K 17/022 403/2
4,720,016 A * 1/1988 Kay ..... A47B 61/003 211/175
4,760,929 A * 8/1988 Fedorchak ..... A47F 7/24 211/105.1
4,771,899 A * 9/1988 Benedict ..... A47B 61/02 211/94.01
5,139,298 A * 8/1992 Dowell ..... A47G 25/145 294/165
5,337,905 A * 8/1994 Gast ..... A47B 61/02 211/85.3
5,351,842 A * 10/1994 Remmers ..... A47F 5/08 108/29
5,499,725 A * 3/1996 Palumbo ..... A47K 3/001 211/119.009
5,531,416 A * 7/1996 Remmers ..... A47G 25/0692 248/222.51
5,582,303 A * 12/1996 Sloan ..... A47G 25/0692 211/105.1
5,697,508 A * 12/1997 Rifkin ..... B65G 9/002 211/124
5,702,010 A * 12/1997 Liang ..... D06F 57/122 211/206
5,803,273 A * 9/1998 Menaged ..... A47F 5/0823 211/105.3
6,053,465 A * 4/2000 Kluge ..... A47B 61/003 248/248
6,409,131 B1 * 6/2002 Bentley ..... A61M 5/1415 248/230.1
6,655,538 B2 * 12/2003 Saulnier-Matteini ..... A47B 45/00 211/175
6,976,595 B1 * 12/2005 Geller ..... A47F 5/0838 211/124
7,490,424 B2 * 2/2009 Caterinacci ..... G09F 7/20 40/606.14
8,002,127 B2 * 8/2011 Ward ..... A47B 61/02 211/124
8,051,781 B1 * 11/2011 Vind ..... A47K 3/38 211/105.6
8,783,474 B2 * 7/2014 Kuhlman ..... A47K 10/04 211/2
9,022,237 B2 * 5/2015 Hall ..... A47B 81/04 211/162
9,089,245 B1 * 7/2015 Pamphilis ..... A47K 10/04
9,290,133 B1 * 3/2016 Bishop ..... A47G 25/0692
9,387,810 B1 * 7/2016 Bishop ..... A47F 5/0006
9,402,494 B1 * 8/2016 O'Brien ..... A47F 7/19
10,021,975 B1 * 7/2018 Womble ..... A47B 96/021
10,449,908 B1 * 10/2019 Bishop ..... B60R 7/10
D893,894 S * 8/2020 Womble ..... D6/327
11,072,292 B1 * 7/2021 Martin, IV ..... B60R 7/10
2002/0148797 A1 * 10/2002 Feder ..... A47F 7/24 211/124
2002/0153337 A1 * 10/2002 Shuen ..... B60R 7/10 211/105.3
2002/0166204 A1 * 11/2002 Chen ..... A47B 61/003 16/87 R
2003/0071001 A1 * 4/2003 Goldberg ..... A47G 25/0692 211/105.3
2003/0111435 A1 * 6/2003 Chen ..... F21V 33/0012 211/105.1
2004/0182808 A1 * 9/2004 Norris, Sr. ..... A47B 61/003 211/105.1
2004/0262249 A1 * 12/2004 Tomonari ..... A47B 57/34 211/90.02
2005/0230577 A1 * 10/2005 Chen ..... A47B 61/003 248/304
2006/0070966 A1 * 4/2006 Koudys ..... A47B 61/02 211/105.3
2006/0231516 A1 * 10/2006 Moore ..... A47G 25/0692 211/85.3
2006/0278594 A1 * 12/2006 Macon ..... A47B 61/003 211/123

(56) References Cited

U.S. PATENT DOCUMENTS

| | | | | |
|---|---|---|---|---|
| 2008/0135508 | A1* | 6/2008 | Fogolin | E04F 10/067 211/105.1 |
| 2008/0156837 | A1* | 7/2008 | Brightman | B60R 7/10 224/313 |
| 2009/0278010 | A1* | 11/2009 | Cotter | A47B 61/003 248/251 |
| 2010/0050425 | A1* | 3/2010 | Ji | H05K 7/1417 29/739 |
| 2010/0282788 | A1* | 11/2010 | Liberti | A47G 25/445 223/96 |
| 2012/0080394 | A1* | 4/2012 | Shorty | A47G 25/0685 211/123 |
| 2013/0113230 | A1* | 5/2013 | Gobart | B60R 7/10 296/1.08 |
| 2014/0126152 | A1* | 5/2014 | Yang | H01L 23/4006 361/704 |
| 2015/0053632 | A1* | 2/2015 | Brinton, Jr. | A47B 61/003 248/225.11 |
| 2015/0335153 | A1* | 11/2015 | Singleton | A47G 25/1457 211/85.15 |
| 2017/0090527 | A1* | 3/2017 | Chi | H05K 7/12 |
| 2017/0332782 | A1* | 11/2017 | Castro | A47G 25/0692 |
| 2018/0055264 | A1* | 3/2018 | Mustafa | A47G 25/0692 |
| 2018/0177292 | A1* | 6/2018 | Rindler | A47B 61/003 |
| 2019/0021491 | A1* | 1/2019 | Womble | F16B 45/00 |
| 2019/0191910 | A1* | 6/2019 | Davis | A47B 61/003 |
| 2022/0241662 | A1* | 8/2022 | Burk | A63B 71/022 |

* cited by examiner

REPOSITIONABLE CLOSET BAR

CROSS-REFERENCE TO RELATED APPLICATIONS

This application is a continuation-in-part of U.S. patent application Ser. No. 17/705,348 filed on Mar. 27, 2022, which application is a continuation-in-part of U.S. patent application Ser. No. 17/239,642 filed on Apr. 25, 2021, where each of the foregoing applications are incorporated by reference herein.

BACKGROUND

The present disclosure relates to closet storage and organization, such as the storage of clothes on clothes hangers.

BACKGROUND OF THE RELATED ART

A closet is a space that is enclosed in some manner for the purpose of storing various items within a residential home, apartment or other building. Closets may be used to store a wide variety of useful and personal items that people generally desire to keep out of constant view, either to maintain an organized and uncluttered appearance or to maintain some privacy regarding the stored items. Therefore, an amount of available closet space is an important factor that people consider when selecting a home or apartment in which to live.

While closets may be added to a home and an existing closet may be expanded to include more space, these are expensive options that may also be detrimental to the functionality or appearance of other spaces within the home. Accordingly, there is much attention given to efficient organization and storage within the available space of an existing closet. Shelving and closet rod systems are a standard feature in most residential closets. Furthermore, custom closet solutions may be designed and installed specifically to address the storage needs of a particular person in a particular closet. In addition to shelving and closet rods, custom closet solutions may include, for example, drawers, cabinets, shoe organizers, and other features that improve the utilization of the existing closet space. Unfortunately, custom closet solutions are also expensive and not a practical option for a person in an apartment where permanent modifications are generally not permitted.

The competing demands placed on a closet and the practical limitations on how a closet can be customized at a reasonable cost have led to the development of numerous independent devices for organizing and storing items. These devices are independent in the sense that they can be easily utilized or implemented without requiring further components or changes to the closet. Examples of these devices may include specialty hangers, storage bins, shoe racks, door-mounted storage, wall hooks, and stackable shelves. However, since the individual preferences of each person are unique, there is a continuing need for devices that will help each person use their own existing closet space in an efficient and appealing manner that satisfies their specific needs and preferences.

BRIEF SUMMARY

Some embodiments provide a repositionable closet bar for hanging clothes comprising an elongate rigid bar having a distal section, a proximal section, an intermediate section between the distal section and the proximal section, and a downward-directed seat. The distal section may have a rectangular profile formed by a flat upward-facing wall for engaging a bottom surface of the closet shelf, a pair of opposing side walls connected to the flat upward-facing wall, and one or more ribs extending between the flat upward-facing wall and the pair of opposing side walls within the rectangular profile. The intermediate section may have a circular arced profile formed by a curved upward-facing wall that extends across a width of the intermediate section for receiving and supporting a hook of a clothes hanger and one or more ribs extending along a concave inner surface of the curved upward-facing wall. The proximal section may have an upward-facing surface that extends radially outward beyond at least a portion of the curved upward-facing wall of the intermediate section. The elongate rigid bar is configured to be positioned between a closet shelf and a closet rod, repositioned side-to-side between the closet shelf and the closet rod and repositioned in a forward direction or a rearward direction between the closet shelf and the closet rod. When in use, no portion of the elongate rigid bar is fastened to the closet shelf and no portion of the elongate rigid bar is fastened to the closet rod. The downward-directed seat is configured to engage an upward-facing surface of the closet rod when the flat upward-facing wall of the distal section engages the bottom surface of the closet shelf.

DETAILED DESCRIPTION

Figure 1A:
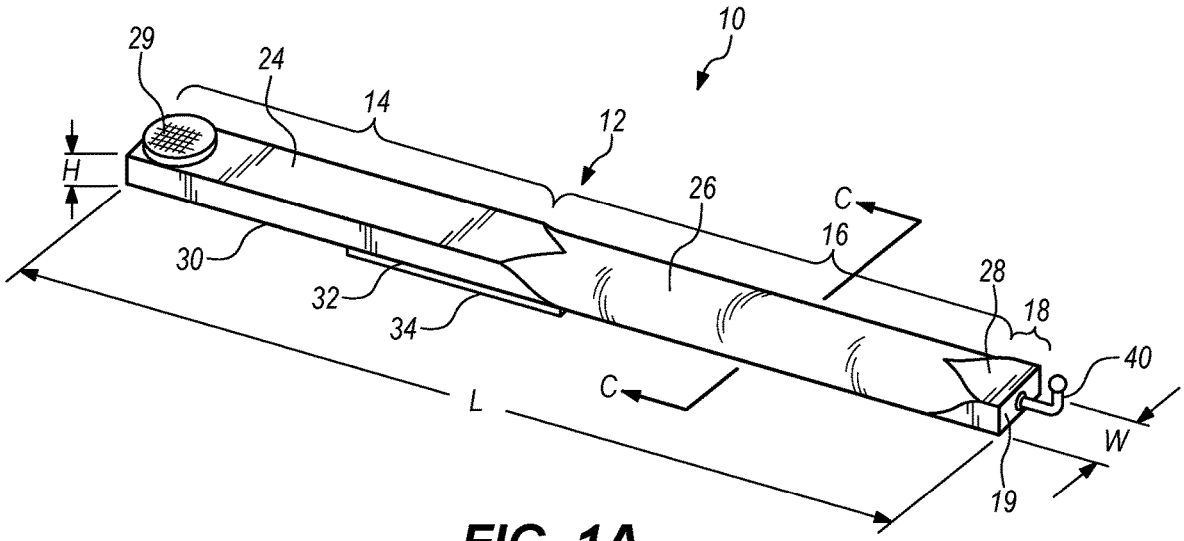
FIG. 1A is a top perspective view of a repositionable closet bar according to some embodiments.

Some embodiments provide a repositionable closet bar for hanging clothes. The repositionable closet bar comprises an elongate rigid bar having a distal section, a proximal section and an intermediate section between the distal section and the proximal section, wherein the distal section has an upward-facing surface for engaging a bottom surface of a closet shelf, wherein the intermediate section has an upward-facing surface that is convex across a width of the intermediate section for receiving and supporting a hook of a clothes hanger, wherein the proximal section has an upward-facing surface that extends radially outward beyond at least a portion of the convex surface of the intermediate section, and wherein the elongate rigid bar further includes a downward-facing surface for engaging a top surface of a closet rod.

Embodiments of the repositionable closet bar may be used in conjunction with a standard closet shelf and closet rod combination or similar installed closet system. A first example of such a standard closet shelf and closet rod combination use a metal bracket to support a closet shelf and to support a closet rod just below the front edge of the shelf. The closet shelf and closet rod are both typically made of wood and are fastened to the metal bracket with screws. A narrow gap between the shelf and the closet rod allows a hook of a clothes hanger to be place over the closet rod. Clothes on clothes hangers may be hung along the entire length of the closet rod. A second example of a standard closet system has an open wire closet shelf and an integral open wire strip for receiving the hooks of numerous clothes hangers. Some embodiments of the repositionable closet bar may be used in conjunction with one or more of these or other closet shelf and closet rod combinations.

Embodiments of the repositionable closet bar may be placed into an operative position for use by grasping the intermediate or proximal sections of the elongate rigid bar so that the elongate rigid bar is oriented for use (i.e., with the top surface of the elongate rigid bar facing upward). Then, the distal section of the elongate rigid bar may be inserted between the lower front edge of the closet shelf and the top surface or edge of the closet rod so that the elongate rigid bar is generally perpendicular to the front edge of the closet shelf and the closet rod. The distal section may be further positioned so that the upward-facing surface of the distal section engages the bottom surface of the closet shelf, such as a mid-point or back portion of the bottom surface of the closet shelf. The elongate rigid bar may then be lowered until the upward-facing surface of the distal section engages the bottom surface of the closet shelf and until the downward-facing surface of the elongate rigid bar rests on the top surface of the closet rod. In this operative position, the proximal section and at least a portion of the intermediate section may extend proximally outward from the closet shelf and the closet rod (i.e., away from the closet wall and toward an accessible area of the closet). Clothes hangers, with or without clothes presently hung on the clothes hangers, may be hung from any portion of the intermediate section that is accessible. In some situations, the intermediate section may be accessible and useable for receiving clothes hangers from the interface with the proximal end of the intermediate section and rearward along the elongate rigid bar to the point where the elongate rigid bar rests on the top surface of the closet rod. However, this situation can only be implemented if there are no clothes hangers hanging from the closet rod for several inches in both directions from where the repositionable closet bar has been located. In a more likely situation, the intermediate section may be accessible and useable for receiving clothes hangers from the proximal end of the intermediate section and rearward along the elongate rigid bar only to the point where there is interference from clothes hangers that are hanging from the closet rod.

Embodiments of the repositionable closet bar may be used in any desirable manner after being placed in an operative position. In a first example, the repositionable closet bar may be used to add storage capacity to a closet. Since the repositionable closet bar may engage the closet rod in an unused space between two adjacent hangers (for example, a gap as little as 1 to 1.5 inches wide), the repositionable closet bar does not significantly interfere with the use of hangers to hang clothes on the pre-existing closet rod and, therefore, there is no loss of storage capacity of the closet rod. Furthermore, since the repositionable closet bar extends beyond the clothes hanger space of the pre-existing closet rod, the hanger space on the repositionable closet bar provides additional hanger space that was not previously present in the closet. So, the repositionable closet bar may be beneficial to an individual with a closet that does not have enough hanging space (i.e., linear length of the closet rod) for all of their hanging clothes (i.e., clothes hung on clothes hangers). In a second example, the repositionable closet bar may be used to display or stage selected clothes in a forward-facing orientation so that the front or back of the clothes on a hanger can be viewed rather than simply seeing a narrow side edge of the clothes. The front of the clothes that are hung on the repositionable closet bar with a hanger is easy for the individual to view since the hanger hangs generally perpendicular to the repositionable closet bar, which means that the hanger hangs generally parallel to the pre-existing closet rod. In the process of selecting two or more clothing pieces to be worn together as an outfit, an individual may prefer to see the front of the clothes and/or see multiple pieces of the outfit together to judge how well they go together or evaluate the overall look of the outfit in view of a particular event where the outfit is to be worn. Furthermore, once a certain outfit has been selected, it may be desirable to hang the clothing pieces of that outfit on the repositionable closet bar so that the outfit is separated from the rest of the individual's wardrobe. Accordingly, the outfit is handy when needed and the clothing pieces are better able to hang free to remove any wrinkles. In embodiments of the repositionable closet bar that include a hook on the proximal end, the individual may further display or stage one or more accessories to the outfit, such as a belt, tie, necklace, scarf and the like. It should also be appreciated that the repositionable closet bar may be used to hang various other personal items, such as a small duffle bag with straps, a bathing suit or towel to be hung while drying, an outfit to be steamed, or a jacket that is too wet or dirty to hang where it contacts other clothes. Even further, if a portion of the closet space located below a closet rod is being used for storage, the repositionable closet bar may still be used to hang some clothes in front of the stored items to increase the storage capacity or to simply hide some of the stored items from view. Still, due to the ease with which the repositionable closet bar can be repositioned within a closet, an individual may use the repositionable closet bar for one purpose in one location of their closet and then quickly use the repositionable closet bar for the same or different purpose in a second location of their closet or another closet. It is also desirable to have multiple units of the repositionable closet bar within a closet to create even more storage capacity and/or to display or stage additional outfits or personal items. Some individuals will enjoy using a first repositionable closet bar to hang a first forward-facing outfit and a second repositionable closet bar to hang a second forward-facing outfit near to the first forward-facing outfit in order to facilitate a comparison and selection of the desired outfit.

Embodiments of the repositionable closet bar may also be used to add storage space that is qualitatively different than any of the storage space that is otherwise available in the closet. For example, a closet having a first lower closet shelf and closet rod combination and a second upper closet shelf and closet rod combination may not provide any long hanging space as is desirable for hanging a long dress. By placing the repositionable closet bar in an operative position in conjunction with the upper closet shelf and closet rod combination, the resulting hanger space created by the repositionable closet bar enables a long dress to be hung in front of both the first and second closet shelf and closet rod combinations without the long dress touching the floor.

It should also be appreciated that a benefit of some embodiments is that the use of the repositionable closet bar in a closet does not require any modification or damage to the existing closet walls, closet shelves or closet rods. This may be of particular benefit to an individual that moves from one apartment to another apartment, since there is no damage to be repaired before moving. Furthermore, the repositionable closet bar can be taken with the individual when they move.

In some embodiments of the repositionable closet bar, the upward-facing surface of the distal section may be flat or otherwise configured for engaging a bottom surface of a shelf, the downward-facing surface of the elongate rigid bar may be flat or otherwise configured for engaging a top surface of a closet rod, and/or the upward-facing surface of the proximal section extends radially outward beyond at least a portion of the convex surface of the intermediate section for preventing the hook of the clothes hanger from sliding over the proximal section.

In some embodiments of the repositionable closet bar, the elongate rigid bar has a sufficient length for at least a portion of the upward-facing surface of the distal section to extend distally to engage the bottom surface of the closet shelf with the downward-facing surface engaging the top surface of the closet rod and for at least a portion of the intermediate section to extend proximally beyond a space for hanging clothes from the closet rod.

In some embodiments of the repositionable closet bar, the elongate rigid bar has a monolithic structure having no fasteners for connecting to the closet shelf, the closet rod, or any other structure. In fact, the elongate rigid bar may be considered to be "floating" in the sense that an individual can freely move the elongate rigid bar side-to-side and/or front-to-back at any moment. The repositionable closet bar can be immediately positioned for use anywhere that there is a closet shelf and closet rod combination without any configuration or installation required. In addition, embodiments having the monolithic structure do not require the use of any tools and have no moving internal parts to wear out or become damaged. In some embodiments, the elongate rigid bar is repositionable side-to-side between a closet shelf and a closet rod (i.e., along the length of the closet rod) and repositionable front-to-back between the closet shelf and the closet rod (i.e., changing the distance from the closet wall) without requiring any reconfiguration of the elongate rigid bar.

In some embodiments, the repositionable closet bar may include one or more first compressible gripping pad secured to the upward-facing surface of the distal section, which may be flat or otherwise configured to receive the first compressible gripping pad. Accordingly, when the repositionable closet bar is placed into an operative position, the first compressible gripping is positioned to engage the bottom surface of the shelf instead of the upward-facing surface. During use of the repositionable closet bar, at least a portion the first compressible gripping pad may be in slight compression between the upward-facing surface of the distal end and the bottom of the closet shelf. The compressibility of the pad enables the pad to contact the bottom surface of the closet shelf over a greater amount of surface area than the solid surface of the distal end, especially considering that the angle between the repositionable closet bar and the bottom of the closet shelf may vary with changes in the front-to-back position of the repositionable closet bar. The first compressible gripping pad or pads may, without limitation, be round or rectangular. Furthermore, the first compressible gripping pad may or may not extend entirely to the distal end or one or both side edges of the upward-facing surface, but is preferably about as broad as the elongate rigid bar to provide stability and additional grip.

In some embodiments, the repositionable closet bar may include one or more second compressible gripping pad secured to the downward-facing surface of the elongate rigid bar, which may be flat or otherwise configured to receive the second compressible gripping pad. Accordingly, when the repositionable closet bar is placed into an operative position, the second compressible gripping pad engages the top of the closet rod instead of the downward-facing surface. During use of the repositionable closet bar, at least a portion of the second compressible gripping pad may be in slight compression between the downward-facing surface and the top surface of the closet rod, which may increase the amount of surface area of the second compressible gripping pad that contacts the closet rod. The second compressible gripping pad may or may not extend to one or both side edges of the downward-facing surface, but is preferably about as broad as the elongate rigid bar to provide stability and further increase the amount of surface area that contributes to gripping the closet rod. However, the second compressible gripping pad is preferably about 6 to about 10 inches in length so that at least a portion of the second compressible gripping pad will engage the top surface of the closet rod over a broad range of front-to-back positions of the repositionable closet bar. For example, with the repositionable closet bar positioned so that the upward-facing surface of the distal section of the elongate rigid bar, or the first compressible gripping pad secured to the upward-facing surface, engages the bottom surface of the closet shelf as near the wall as possible, then a proximal portion of the second compressible gripping pad will preferably engage the top surface of the closet rod. Furthermore, with the repositionable closet bar positioned so that the upward-facing surface of the distal section of the elongate rigid bar, or the first compressible gripping pad secured to the upward-facing surface, engages the bottom surface of the closet shelf at a mid-point of the closet shelf from front to back, then a distal portion of the second compressible gripping pad will preferably engage the top surface of the closet rod. Optionally, the position and length of the second compressible gripping pad may be used to inform or guide an individual as to the limits of a recommended range of front-to-back positions for the elongate rigid bar. While the back wall of the closet behind the closet shelf is one physical limit for the distal section, the elongate rigid bar is preferably not positioned so far forward that the upward-facing surface of the distal section, or the first compressible gripping pad secured to the upward-facing surface, no longer firmly or squarely engages the bottom surface of the closet shelf. For a closet shelf and closet rod combination having a 1 inch to 1.5 inch vertical gap between the bottom of the closet shelf and the top of the closet rod, it is preferable for the upward-facing surface of the distal section, or the first compressible gripping pad secured to the upward-facing surface, to engage the bottom of the shelf about 6 inches or more back from the front edge of the closet shelf.

In some embodiments, the repositionable closet bar may include a hook extending from a proximal end of the elongate rigid bar. The hook may be any useful shape or type, such as a straight hook, curved hook, or an L-shaped hook. The hook preferably extends in a longitudinal direction relative of the elongate rigid bar. The elongate rigid bar has a length (longitudinal dimension) that is several multiples greater than either the height (vertical dimension) or the width (lateral dimension), and the hook may extend in the longitudinal direction from the proximal end of the elongate rigid bar.

In some embodiments of the repositionable closet bar, the upward-facing convex surface of the intermediate section may have a continuous radius of curvature. In one option, the upward-facing convex surface of the intermediate section may have a radius from about 0.5 inch to about 0.75 inch (i.e., a diameter from about 1.0 inch to about 1.5 inch). In another option, the intermediate section may have a cross-sectional profile that is semicircular. A preferred upward-facing convex surface has a size and curvature, such as a radius, that is substantially the same or similar to the closet rod such that hangers will hang on the upward-facing convex surface of the repositionable closet bar in the same manner as they hang on the closet rod.

In some embodiments of the repositionable closet bar, the distal section may have a rectangular cross-sectional profile (i.e., width and height) and/or the proximal section may have a rectangular cross-sectional profile (i.e., width and height). The rectangular cross-section profile provides good strength to oppose the forces placed upon the repositionable closet bar while simultaneously preventing clothes hangers from sliding beyond the intermediate section in either the proximal or distal direction.

In some embodiments of the repositionable closet bar, the elongate rigid bar may have a constant width along the entire length of the elongate rigid bar and/or the elongate rigid bar may have a downward-facing surface that is flat along the entire length of the elongate rigid bar. While the elongate rigid bar may have various widths along its length and/or may have a non-flat surface over a portion of the downward-facing surface, a constant width and flat downward-facing surface along the entire length of the elongate rigid bar may be convenient for manufacturing, provide durability and strength for long term use, and create an elegant appearance.

In some embodiments of the repositionable closet bar, the elongate rigid bar may be made from or with a material selected from wood, plastic, metal, stone (such as granite), ceramic, glass and composites. In one option, the compressible gripping pads may be made with rubber, elastomers and/or other polymers or polymer composites. Non-limiting examples of elastomers, such as thermoset and thermoplastic elastomers, include ethylene propylene copolymers, epichlorohydrin, polyacrylic rubber, silicone rubber, polyurethanes, polyamides, polyvinyl chloride, polyester, and polyvinyl chloride coated polyester. The compressible gripping pads preferably have a high grip under even small compression forces. The grip provided by the compressible gripping pads may oppose or prevent the repositionable closet bar from sliding side-to-side and/or pivoting as the individual interacts with the repositionable closet bar, such as placing clothes hangers onto the intermediate section of the repositionable closet bar. One example of a material useful for the compressible gripping pads is commercially available as DYCEM (a registered trademark of Dycem Corporation). Furthermore, the compressible gripping pads may, without limitation, be secured to the elongate rigid bar with an adhesive, such as a self-stick adhesive, or by use of a staple, nail or screw. The hook is preferably made of a metal.

In some embodiments of the repositionable closet bar, the elongate rigid bar may be straight. For example, the elongate rigid bar may be formed from a straight wood board that has a substantially uniform height and width from the distal end to the proximal end. Accordingly, the convex surface of the intermediate section must be cut into the wood board from a point of interface with the proximal section to a point of interface with the distal section. For example, a router or shaper that is equipped with a roundover bit or a bullnose bit may be used to form the convex surface of the intermediate section. Other possible manufacturing techniques may also be used to form the repositionable closet bar. For example, a plastic version may be made through injection molding and a metal version may be made by casting, metal bending and/or machining.

The dimensions of the elongate rigid bar may vary, but there are limits to each dimension based upon the dimensions of the closet shelf and closet rod combination that is available in the closet. The following dimensions for the elongate rigid bar are stated for use in conjunction with the closet shelf and closet rod combination formed using a standard closet shelf bracket, such as those available as BLUE HAWK 12.8 inch shelf bracket for shelf boards up to 14 inches deep and closet rods up to 1.25 inches in diameter, which leaves a gap of about 1.25 inch between the bottom of the closet shelf and the top surface of a 1.25 inch diameter closet rod. It should be understood that the dimensions of the elongate rigid bar stated below may be modified for use with other types or sizes of closet shelf and closet rod combinations.

The length (longitudinal dimension) of the elongate rigid bar is preferably long enough to extend under the shelf at least about 6 inches and is preferably able to extend beyond a clothes hanger space of the closet rod by about 6 inches. Since a standard hanger may be about 16 inches from end-to-end (i.e., shoulder-to-shoulder), the clothes hanger space may include about 8 inches to the front and back of the closet rod. Accordingly, the longitudinal dimension of the elongate rigid bar may range from 16 to 32 inches, preferably from 22 to 28 inches, and most preferably from 24 to 26 inches.

The width (lateral dimension) of the elongate rigid bar is preferably wide enough to prevent any twisting of the elongate rigid bar under various forces applied to the repositionable closet bar during normal use, such as the hanging of clothes hangers onto the intermediate section or a person bumping up against clothes that are already hung on the intermediate section by clothes hangers. However, the elongate rigid bar is preferably not so wide as to overlap any more of the useful area of the closet rod than necessary, and the intermediate section is preferably not so wide that a hook of a clothes hanger will not fully seat or rest on the upward-facing convex surface of the intermediate section. Optionally, the distal and proximal sections could be wider than the intermediate section if desirable to increase stability. In some embodiments, the lateral dimension (width) of the elongate rigid bar may range from 1 to 1.5 inches, and preferably from 1.25 to 1.5 inches.

The height or thickness (vertical dimension) of the elongate rigid bar is preferably sufficient to provide support for heavy clothes hung on clothes hangers over the length of the intermediate section, but the vertical dimension must not be so great as to prevent the elongate rigid bar from being positioned between the bottom surface of the closet shelf and the top surface of the closet rod. Furthermore, the vertical dimension is preferably allows the elongate rigid bar to be positioned between the bottom surface of the closet shelf and the top surface of the closet rod, preferably with sufficient clearance that the first and second compressible gripping pads, if any, are not damaged or pulled off as the repositionable closet bar is being placed into an operative position. Still further, the elongate rigid bar is preferably not so thick that the upward-facing surface of the distal section or the first compressible gripping pad won't engage the bottom surface of the shelf. Accordingly, the vertical dimension of the elongate rigid bar may be in a range from 0.5 to 1.25 inches, preferably from 0.5 to 1 inches, and most preferably from 0.5 to 0.75 inches.

Some embodiments of the repositionable closet bar may include additional elements without departing from the scope of the embodiment. Such embodiments may be described in the claims using the transitional term "comprising", which is synonymous with "including," "containing," or "characterized by," and is inclusive or open-ended and does not exclude additional, unrecited elements. Some other embodiments may be limited to certain specifically stated elements and may be described in the claims using the transitional term "consisting of" to exclude any element not specifically recited. Still other embodiments may be described in the claims using the transitional phrase "consisting essentially of" to limit the scope of the embodiment to the specified elements as well as those elements that do not materially affect the basic and novel characteristic(s) of the embodiment.

Some embodiments provide a repositionable closet bar for hanging clothes consisting essentially of an elongate rigid bar, a hook, and first and second compressible gripping pads. The elongate rigid bar has a distal section, a proximal section and an intermediate section between the distal section and the proximal section, wherein the distal section has an upward-facing surface, wherein the intermediate section has an upward-facing surface that is convex across a width of the intermediate section for receiving an supporting a hook of a clothes hanger, wherein the proximal section has an upward-facing surface that extends radially outward beyond at least a portion of the convex surface of the intermediate section, and wherein the elongate rigid bar further includes a downward-facing surface. The hook extends from a proximal end of the elongate rigid bar in a longitudinal direction of the elongate rigid bar. The first compressible gripping pad is secured to the upward-facing surface of the distal section for engaging a bottom surface of a closet shelf and the second compressible gripping pad is secured to the downward-facing surface of the elongate rigid bar for engaging a top surface of a closet rod.

FIG. 1A is a top perspective view of a repositionable closet bar 10 for hanging clothes according to some embodiments. The repositionable closet bar 10 comprises an elongate rigid bar 12 having a distal section 14, a proximal section 18 and an intermediate section 16 between the distal section 14 and the proximal section 18. The distal section 14 has an upward-facing surface 24 that is flat, the intermediate section 16 has an upward-facing surface 26 that is convex across a width of the intermediate section 16, the proximal section 18 has an upward-facing surface 28 that extends radially outward beyond at least a portion of the convex surface 26 of the intermediate section 16, and a downward-facing surface 30 of the elongate rigid bar 12 includes a flat section 32. Although the repositionable closet bar 10 is not in its operative position in conjunction with a closet shelf and closet rod combination (see FIG. 2), the repositionable closet bar 10 is in the same orientation as it would be in an operative position. Accordingly, the upward-facing surfaces 24, 26, 28 are shown facing upward. For example, the upward-facing convex surface 26 is oriented to receive a hook of a clothes hanger.

The upward-facing surface 24 of the distal section 14 preferably includes a first compressible gripping pad 29 that is adhered to the upward-facing surface 24 and is positioned for engaging a bottom surface of a closet shelf. As shown, the first compressible gripping pad 29 is positioned at a distal end of the surface 24. The flat section 32 of the downward-facing surface 30 preferably includes a second compressible gripping pad 34 for engaging a top surface of a closet rod. The repositionable closet bar 10 further includes a L-shaped hook 40 that extends from the proximal end 19.

The repositionable closet bar 10 has a length (longitudinal dimension) "L", a width (lateral dimension) "W", and a height or thickness (vertical dimension) "H" as shown in FIG. 1A. In the embodiment shown, the repositionable closet bar 10 has a uniform width W and height H along the length L of the elongate rigid bar 12, although the intermediate section 16 has an upward-facing convex surface 26.

Figure 1B:
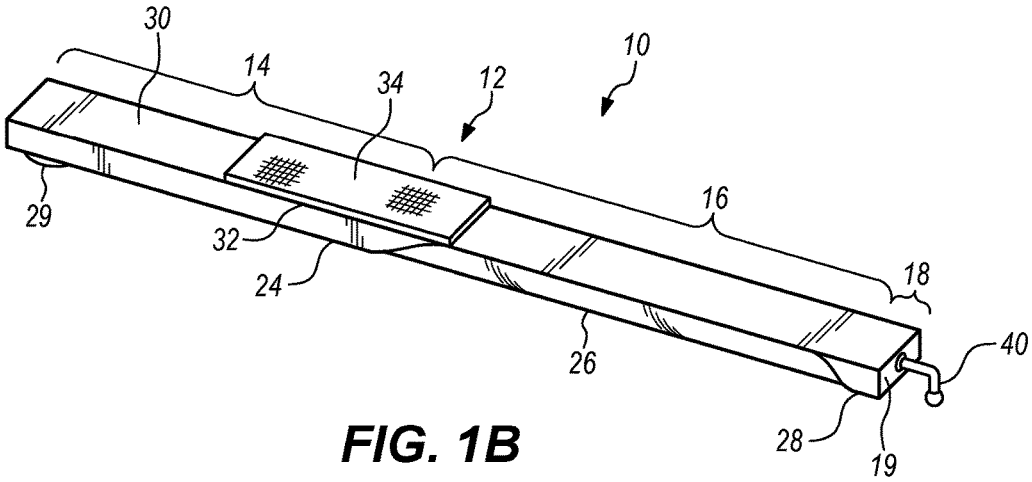
FIG. 1B is a bottom perspective view of the repositionable closet bar of FIG. 1A.

FIG. 1B is a bottom perspective view of the repositionable closet bar 10 of FIG. 1A. This view illustrates the downward-facing surface 30 and the second compressible gripping pad 34 that is adhesively secured to a flat or otherwise suitably shaped portion of the downward-facing surface 30 for engaging a top surface of a closet rod. Other reference numbers identified in FIG. 1B are the same reference numbers previously identified in reference to FIG. 1A and are duplicated in FIG. 1B for context.

Figure 1C:
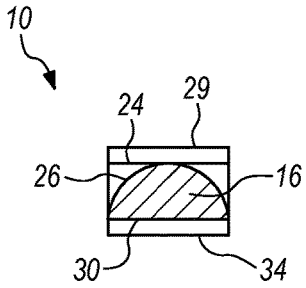
FIG. 1C is a cross-sectional diagram of an intermediate section of the repositionable closet bar of FIG. 1A.

FIG. 1C is a cross-sectional diagram of an intermediate section 16 of the repositionable closet bar 10 taken along line C-C shown in FIG. 1A. The cross-section cuts through the intermediate section 16 and shows that the intermediate section 16 has a semicircular profile. Specifically, the semicircular profile includes the downward-facing surface 30 that is flat and the upward-facing convex surface 26 that is a circular arc. Other upward-facing convex shapes may be similarly implemented. In the background of the cross-sectional cut through the intermediate section 16, FIG. 1C also shows the upward-facing surface 24 of the distal section, the first compressible gripping pad 29 that is secured to the upward-facing surface 24 of the distal section, and the second compressible gripping pad 34 that is secured to the downward-facing surface 30 of the elongate rigid bar.

Figure 1D:
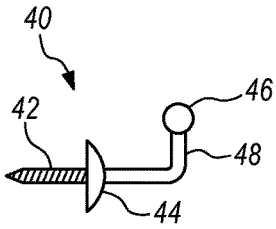
FIG. 1D is a side view of a hook that is attached to the repositionable closet bar of FIG. 1A.

FIG. 1D is a side view of a hook 40 that is attachable to the proximal end 19 of the repositionable closet bar 10 shown in FIG. 1A. The hook 40 has an L-shaped shaft 48 and has screw threads 42 for threadably securing the hook into a drilled or formed hole in the proximal end 19 of the repositionable closet bar 10. The illustrated hook 40 has a decorative stop collar 44 and a spherical tip 46 that eliminates sharp edges that could snag fabric.

Figure 2:
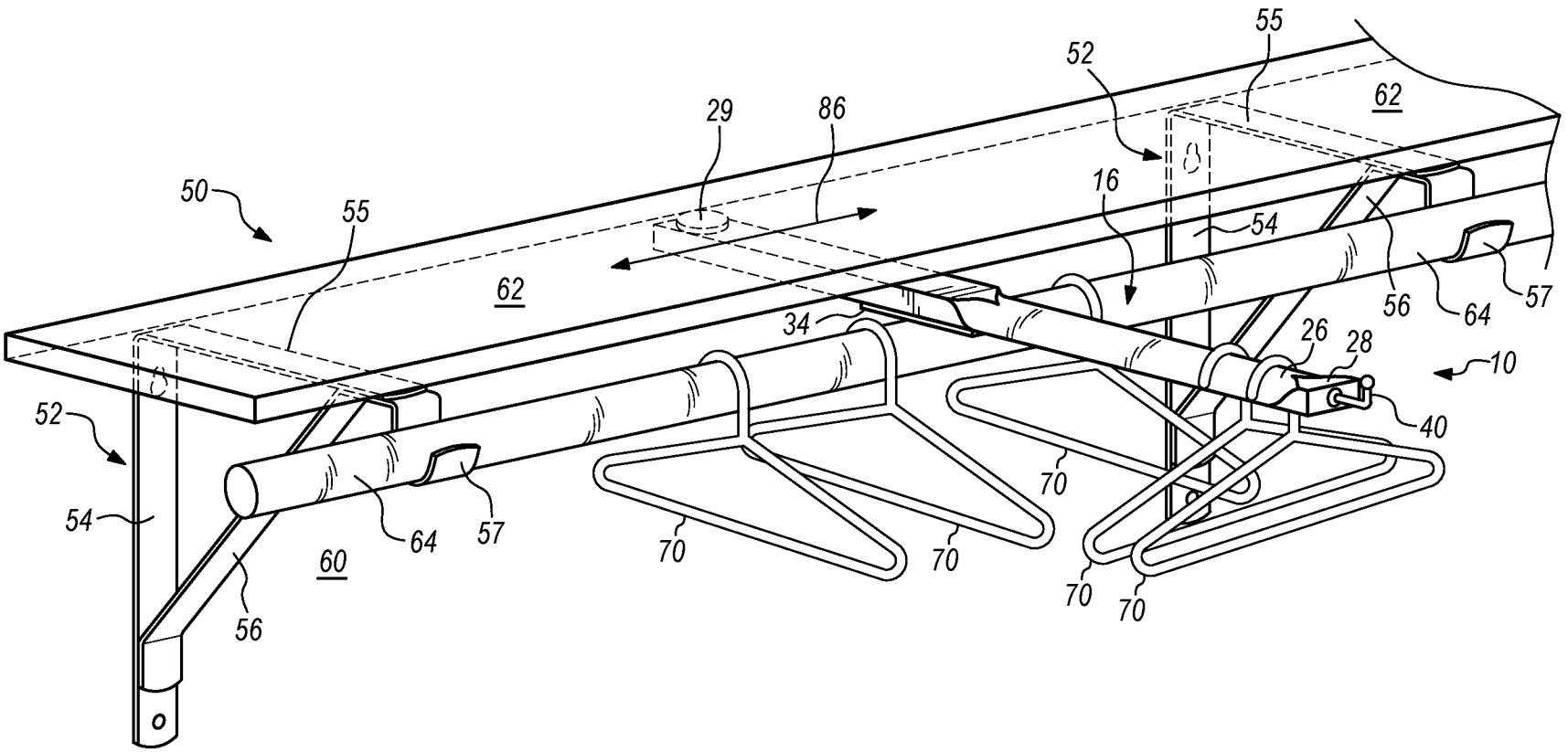
FIG. 2 is a perspective view of the repositionable closet bar in an operative position for use in conjunction with a first standard closet shelf and closet rod combination.

FIG. 2 is a perspective view of the repositionable closet bar 10 in an operative position for use in conjunction with a standard closet shelf and closet rod combination 50. The illustrated standard closet shelf and closet rod combination 50 includes a pair of brackets 52 that are each secured to a closet wall 60. Each bracket 50 includes a vertical plate 54 that is attached to the wall 60 with screws (not shown; but screwed through the bracket into studs within the wall), a horizontal plate 55 for supporting and securing the shelf 62, an angled brace plate 56 for providing support to the horizontal plate 55, and a closet rod holder 57 extending down from the horizontal plate 55. The shelf 62 lays across the two horizontal plates 55 and a closet rod 64 lays across the two closet rod holders 57. The shelf 62 is preferably secured to the two horizontal plates 55 with screws (not shown) and the closet rod 64 is preferably secured to the two closet rod holders 57 with screws (not shown). In some closet configurations, one or more ends of the shelf 62 may be supported by a shelf support board and/or one or more ends of the closet rod 64 may be supported with a simple closet rod bracket (not shown) having either an open-lip flange or closed-lip flange. Accordingly, while there is preferably at least one of the brackets 52 present to establish the standard spacing between the closet shelf and the closet rod, the number of brackets is not critical and is primarily a function of the distance that the closet shelf and closet rod extend. The standard closet shelf and closet rod combination 50 is a common feature of a closet in new home construction. Accordingly, an individual may store boxes or other items on top of the shelf 62 and may hang clothes on clothes hangers 70 from the closet rod 64 along the entire length of the closet rod 64.

The repositionable closet bar 10 is shown in an operative position with the first compressible gripping pad 29 engaging the bottom (underneath) side of the shelf 62 and the second compressible gripping pad 34 engaging the top surface or edge of the closet rod 64. In this operative position, at least a portion of the intermediate section 16 extends in a proximal direction (away from the wall 60 and toward the closet space accessible to an individual) beyond the clothes hanging space used for hanging clothes hangers 70 from the closet rod 64. Accordingly, a small number of additional hangers 70 may be received and supported on the upward-facing convex surface 26. Notice that the proximal section 18 has an upward-facing surface that extends radially outward beyond at least a portion of the convex surface 26 of the intermediate section 16 such that the hangers 70 are prevented from sliding off the proximal end of the repositionable closet bar 10.

It is shown that the hangers 70 and clothes (clothes not shown) hung on the repositionable closet bar 10 may avoid interfering with the hangers 70 and clothes (clothes not shown) hung on the closet rod 64. Furthermore, the hangers 70 hung on the repositionable closet bar 10 hang parallel to the closet rod 64 and front edge of the closet shelf 62 such that clothes (not shown) hung on the repositionable closet bar 10 are front-facing (or perhaps back-facing, if desired) into the closet for optimal viewing by an individual. By contrast, clothes (not shown) hung from the hangers 70 on the closet rod 64 are sideways to the individual in the closet such that only a narrow edge of the clothes can be seen. Note that various clothing accessories, such as a belt, tie, or necklace, may also be hung from the hook 40 to hang downward in front of the hangers 70 and clothes (clothes not shown) hung on the repositionable closet bar 10.

Notice that the repositionable closet bar 10 is not fastened to the closet shelf 62 or the closet rod 64 and may be quickly and simply repositioned left or right (see double-headed arrow 86). The repositionable closet bar 10 may be repositioned by grabbing the bar at any point, such as the intermediate section, and then sliding the bar (i.e., generally translational movement) along the closet shelf 62 and the closet rod 64. Alternatively, the repositionable closet bar 10 may be repositioned by grabbing the bar at any point, withdrawing the bar from between the closet shelf 62 and closet rod 64 in its current position, and then repositioning the bar between the closet shelf 62 and closet rod 64 in a new desired position. This later alternative allows repositioning without disturbing any of the hangers hung to the left side or right side of the repositionable closet bar 10. Repositioning the repositionable closet bar 10 takes only a few seconds of time and no more effort than repositioning a clothes hanger 70 on the closet rod 64.

Figure 3A:
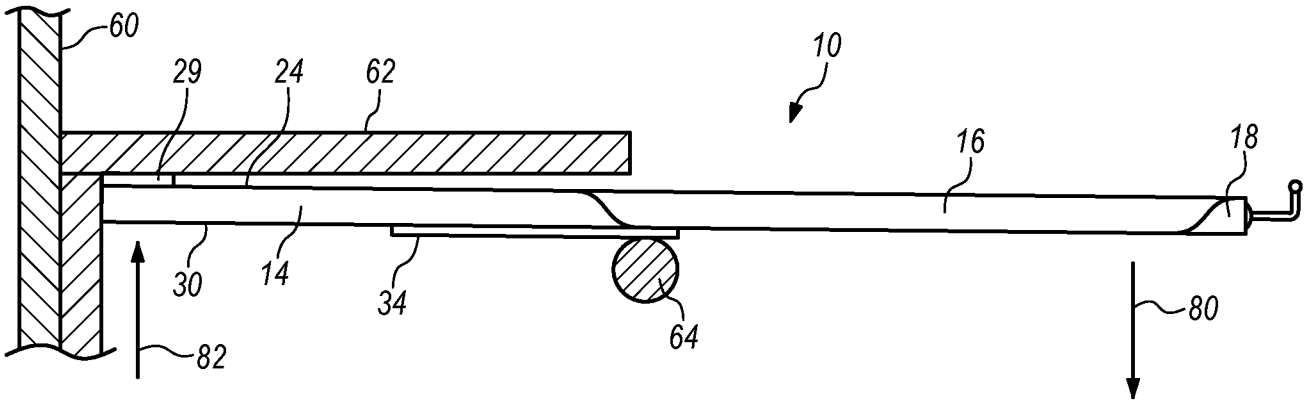
FIGS. 3A-B are side views of the repositionable closet bar in first and second operative positions relative to the standard closet shelf and closet rod combination.
Figure 3B:
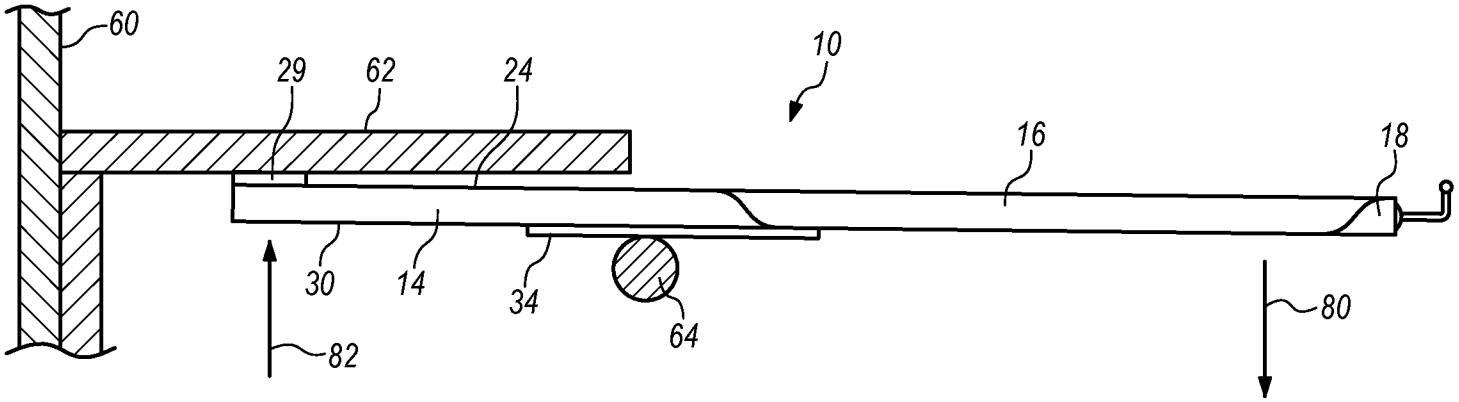

FIGS. 3A-B are side views of the repositionable closet bar 10 in first and second operative positions relative to the closet wall 60, as well as the closet shelf 62 and closet rod 64 of the standard closet shelf and closet rod combination 50 (see FIG. 2). In FIG. 3A, the repositionable closet bar 10 is shown in a first operative position as far as possible toward the back of the shelf 62 (i.e., toward the wall 60). The first compressible gripping pad 29 is secured to the upward-facing surface 24 of the distal section and engages the bottom (underneath) side of the closet shelf 62. The second compressible gripping pad 34 is secured to the downward-facing surface 30 and engages the top surface or edge of the closet rod 64. In this position, the closet rod 64 acts as a fulcrum and the repositionable closet bar 10 acts as a lever. Accordingly, hanging clothes on the intermediate section 16 applies a downward force (see arrow 80) on a proximal portion of the repositionable closet bar 10, which in turn applies an upward force (see arrow 82) on the distal section 14 and the first gripping pad 29, if used. Therefore, the repositionable closet bar 10 is held in place without any fasteners or any tools.

In FIG. 3B, the repositionable closet bar 10 is shown in a second operative position that is a distance forward off the back of the shelf 62 (i.e., a distance away from the wall 60). In this second operative position, the first compressible gripping pad 29 is secured to the upward-facing surface 24 of the distal section and engages the bottom (underneath) side of the closet shelf 62 in a similar manner to the first operative position of FIG. 3A. The second compressible gripping pad 34 is secured to the downward-facing surface 30 and engages the top surface or edge of the closet rod 64 in a similar manner to the first operative position of FIG. 3A. Accordingly, the repositionable closet bar 10 is held in place without any fasteners or any tools. The primary difference between the first operative position of FIG. 3A and the second operative position of FIG. 3B is that the second operative position extends the repositionable closet bar 10 further in the proximal direction (i.e., to the right in FIGS. 3A and 3B). As a result, the second operative position makes a greater amount of the intermediate section 16 available for receiving hangers. Notice that the second compressible gripping pad 34 still engages the top of the closet rod 64, but it does so at a different point. Optionally, the repositionable closet bar 10 could be repositioned even further forward, but it is recommended that the first compressible gripping pad 29, or the distal position of the distal section 14, remain positioned under a middle portion of the closet shelf 62 for the purpose of stability and security. In a preferred option, the length and position of the second compressible gripping pad 34 on the downward-facing surface 30 may be selected to provide guidance to an individual as to how far the repositionable closet bar 10 may repositioned forward.

Figure 4:
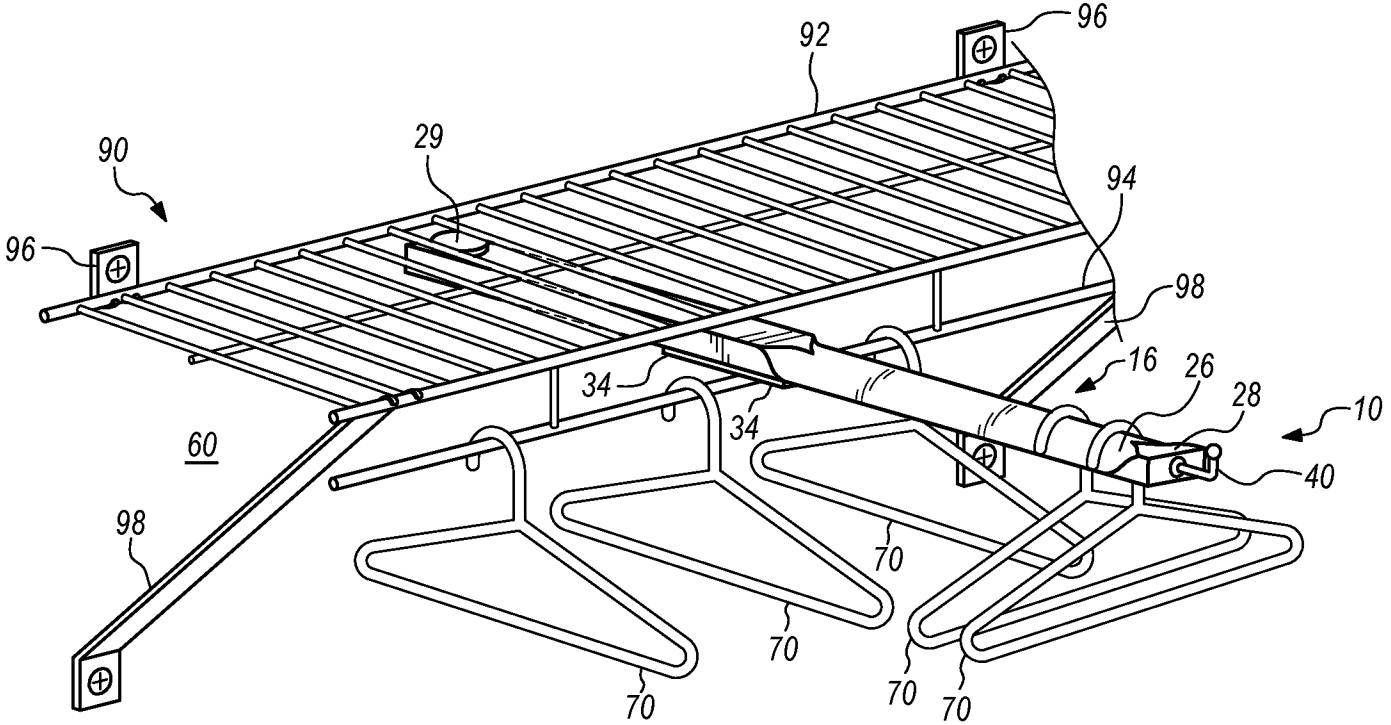
FIG. 4 is a perspective view of the repositionable closet bar in an operative position for use in conjunction with a second standard closet shelf and closet rod combination made of wire.

FIG. 4 is a perspective view of the repositionable closet bar 10 in an operative position for use in conjunction with a second standard closet shelf and closet rod combination 90 made of wire. The closet shelf is formed by an open wire shelf structure 92 and the closet "rod" is formed by a support wire 94. The open wire shelf structure 92 is supported along a back edge by plastic brackets 96 that are fastened to the wall 60 with screws and is supported along the front edge by metal braces 98 that are similarly fastened to the wall 60 with screws.

The repositionable closet bar 10 is placed in the operative position in the same manner as in reference to FIG. 2 and is repositioned in the same manner as in reference to FIG. 2 (side-to-side) and 3A-B (front-to-back). The first gripping pad 29 (as seen through the gaps between adjacent wires of the closet shelf 92) is upward facing on the distal section that extends between the closet shelf 92 and the wire support 94 and then under the shelf 92, such that the first gripping pad 29 engages the bottom surface of the wires that make up the open wire shelf structure 92. The second gripping pad 34 on the downward-facing surface of the repositionable closet bar 10 engages the top surface of the support wire 94 that is provided for hanging clothes hangers 70. Accordingly, the proximal section 18 of the repositionable closet bar 10 extends outward such that additional hangers 70 can be hung on an accessible portion of the upward-facing convex surface 26 of the intermediate section 16. It is a benefit of some embodiments, such as is shown in FIGS. 2 and 4 that the repositionable closet bar 10 may be used in both first and second standard closet shelf and closet rod combinations 90.

Some embodiments provide a repositionable closet bar for hanging clothes comprising an elongate rigid bar having a distal section, a proximal section, an intermediate section between the distal section and the proximal section, and a downward-directed seat. The distal section may have a rectangular profile formed by a flat upward-facing wall for engaging a bottom surface of the closet shelf, a pair of opposing side walls connected to the flat upward-facing wall, and one or more ribs extending between the flat upward-facing wall and the pair of opposing side walls within the rectangular profile. The intermediate section may have a circular arced profile formed by a curved upward-facing wall that extends across a width of the intermediate section for receiving and supporting a hook of a clothes hanger and one or more ribs extending along a concave inner surface of the curved upward-facing wall. The proximal section may have an upward-facing surface that extends radially outward beyond at least a portion of the curved upward-facing wall of the intermediate section. The elongate rigid bar is configured to be positioned between a closet shelf and a closet rod, repositioned side-to-side between the closet shelf and the closet rod and repositioned in a forward direction or a rearward direction between the closet shelf and the closet rod. When in use, no portion of the elongate rigid bar is fastened to the closet shelf and no portion of the elongate rigid bar is fastened to the closet rod. The downward-directed seat is configured to engage an upward-facing surface of the closet rod when the flat upward-facing wall of the distal section engages the bottom surface of the closet shelf.

In some embodiments, the downward-directed seat may include one or more surfaces lying in a plane that is parallel to a plane of the flat upward-facing wall of the distal section. The one or more surfaces may be a single continuous surface or a collection of multiple surfaces, such as the surfaces of the pair of opposing sidewalls and/or the surface of one or more ribs. However, the one or more surfaces may simultaneously engage the closet rod. Optionally, a gripping material or pad may be secured to the one or more surfaces.

In some embodiments, the downward-directed seat may include one or more surfaces lying along a concave arc having an axis that is perpendicular to a longitudinal axis of the elongate rigid bar and parallel to a plane of the flat upward-facing wall of the distal section. The one or more surfaces may be a single continuous surface or a collection of multiple surfaces, such as the surfaces of the pair of opposing sidewalls and/or the surface of one or more ribs. However, the one or more surfaces may simultaneously engage the closet rod. In one option, a gripping material or pad may be secured to the one or more surfaces. In a separate option, the concave arc may have a radius that is approximately the same as a radius of the closet rod such that there may be an increased area of contact between the downward-directed seat and the closet rod. Furthermore, the downward-directed seat may be included in a plurality of identical downward-directed seats, such as a set of seats arranged closely together. A user may then position the elongate rigid bar so that any one of the downward-directed seats engages the closet rod, where each seat causes the elongate rod to extend forwardly to a greater or lesser extent beyond the closet rod or a space for hanging clothes from the closet rod.

In some embodiments, the circular arced profile of the intermediate section may be a semicircular profile. Accordingly, the upward-facing surface is rounded and may have the same radius as a standard closet rod so that any hanger and other device that can be hung from a standard closet rod may also be hung from the intermediate section of the elongate bar of the repositionable closet bar.

Some embodiments may utilize a compressible gripping material, such as an adhesively secured gripping pad, in a position to engage the closet shelf and/or the closet rod. The use of a compressible gripping material may reduce or eliminate scratching of the shelf and/or rod and may also reduce or eliminate unintended shifting or movement of the repositionable closet bar during use. In one option, a first compressible gripping material may be secured to the flat upward-facing wall of the distal section for engaging the bottom surface of the closet shelf. In another option, a second compressible gripping material may be secured to the downward-directed seat for engaging the upward-facing surface of the closet rod.

In some embodiments, the repositionable closet bar may be made with plastic. For example, the repositionable closet bar may be made using an injection molding process. The use of a ribbed structure viewable from the bottom of the repositionable closet bar maintains the strength of the bar using less plastic. However, it should be understood other aspect of the repositionable closet bar may be same or similar to those of previously described embodiments. For example, the configuration and/or dimensions of the repositionable closet bar may be the same as described for any of the embodiments herein. Briefly, without limitation, the curved upward-facing wall of the intermediate section may have a radius from about 0.5 inch to about 0.75 inch, wherein the elongate rigid bar has a height that is less than about 1.0 inch; at least a portion of the intermediate section may be configured to extend forwardly beyond a space for hanging clothes from the closet rod; the elongate rigid bar may have a constant width along its length from a proximal end to a distal end; the elongate rigid bar may be straight; and/or the elongate rigid bar may have a height from 0.5 to 1.25 inches, a width from 1 to 1.5 inches, and a length from 16 to 32 inches.

In some embodiments, the repositionable closet bar may further comprise a hook that extends in a longitudinal direction from a proximal end of the proximal section of the elongate rigid bar. The hook is preferably formed in a single molding step along with the entirely of the elongate rigid bar.

In some embodiments, the one or more ribs in the distal section use less material per unit of length along a longitudinal axis of the elongate rigid bar than the one or more ribs in the intermediate section and/or the proximal section. A repositionable closet bar that has more weight forward (proximal direction) of a point of engagement with the closet rod than in back (distal direction) of the point of engagement will be stable in an operable position even without having any hangers or other items hanging from the intermediate section or hook. In one option, the rib density may be reduced (rib spacing increased) in the distal section relative to the rib density or spacing in the intermediate and/or proximal sections. In another option, the proximal section and/or intermediate section may have thicker ribs and/or a solid block of plastic to increase the weight in the proximal section and/or intermediate section.

Some embodiments provide a repositionable closet bar for hanging clothes consisting essentially of an elongate rigid bar having a distal section, a proximal section, an intermediate section between the distal section and the proximal section, and a downward-directed seat. The distal section may have a rectangular profile formed by a flat upward-facing wall for engaging a bottom surface of the closet shelf, a pair of opposing side walls connected to the flat upward-facing wall, and one or more ribs extending between the flat upward-facing wall and the pair of opposing side walls within the rectangular profile. The intermediate section may have a circular arced profile formed by a curved upward-facing wall that extends across a width of the intermediate section for receiving and supporting a hook of a clothes hanger and one or more ribs extending along a concave inner surface of the curved upward-facing wall. The proximal section may have an upward-facing surface that extends radially outward beyond at least a portion of the curved upward-facing wall of the intermediate section. The elongate rigid bar is configured to be positioned between a closet shelf and a closet rod, repositioned side-to-side between the closet shelf and the closet rod and repositioned in a forward direction or a rearward direction between the closet shelf and the closet rod. When in use, no portion of the elongate rigid bar is fastened to the closet shelf and no portion of the elongate rigid bar is fastened to the closet rod. The downward-directed seat is configured to engage an upward-facing surface of the closet rod when the flat upward-facing wall of the distal section engages the bottom surface of the closet shelf.

Figure 5A:
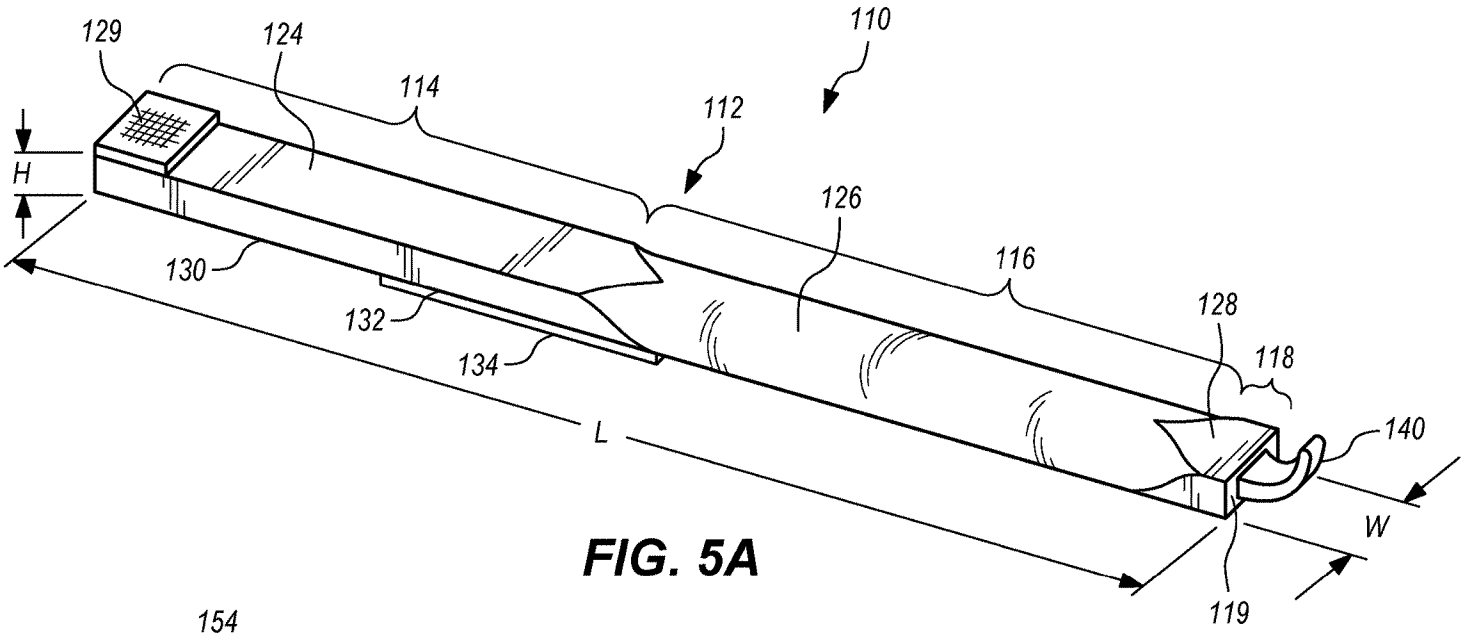
FIGS. 5A-B are top and bottom perspective views of a repositionable closet bar formed by a molding process.

FIG. 5A is a top perspective view of a repositionable closet bar 110 formed by a molding process. The repositionable closet bar 110 comprises an elongate rigid bar 112 having a distal section 114, a proximal section 118 and an intermediate section 116 between the distal section 114 and the proximal section 118. The distal section 114 has an upward-facing surface 124 that is flat, the intermediate section 116 has an upward-facing surface 126 that is convex across a width of the intermediate section 116, the proximal section 118 has an upward-facing surface 128 that extends radially outward beyond at least a portion of the convex surface 126 of the intermediate section 116, and a downward-facing surface 130 of the elongate rigid bar 112 includes a flat section 132. Although the repositionable closet bar 110 is not in its operative position in conjunction with a closet shelf and closet rod combination (see FIGS. 2 and 8A-B), the repositionable closet bar 110 is in the same orientation as it would be in an operative position. Accordingly, the upward-facing surfaces 124, 126, 128 are shown facing upward. For example, the upward-facing convex surface 126 is oriented to receive a hook of a clothes hanger.

The upward-facing surface 124 of the distal section 114 preferably includes a first compressible gripping pad 129 that is adhered to the upward-facing surface 124 and is positioned for engaging a bottom surface of a closet shelf. As shown, the first compressible gripping pad 129 is positioned at a distal end of the surface 124. The flat section 132 of the downward-facing surface 130 preferably includes a second compressible gripping pad 134 for engaging a top surface of a closet rod. The repositionable closet bar 110 further includes a L-shaped hook 140 that extends from the proximal end 119.

The repositionable closet bar 110 has a length (longitudinal dimension) "L", a width (lateral dimension) "W", and a height or thickness (vertical dimension) "H" as shown in FIG. 5A. In the embodiment shown, the repositionable closet bar 10 has a uniform width W and height H along the length L of the elongate rigid bar 12, although the intermediate section 16 has an upward-facing convex surface 126. The appearance of the repositionable closet bar 110 may be substantially similar to the repositionable closet bar 10 (See FIG. 1A).

Figure 5B:
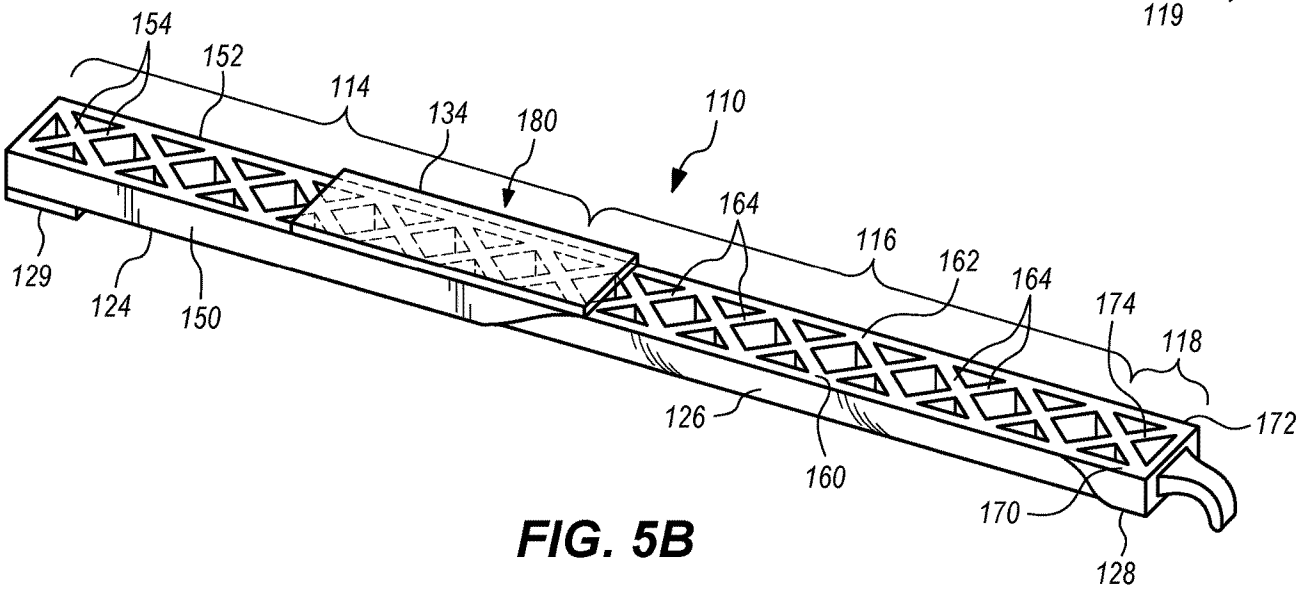

FIG. 5B is a bottom perspective view of the repositionable closet bar 110 formed by a molding process. The distal section 114 has a rectangular profile formed by the flat upward-facing wall 124 (facing down in FIG. 5B) and a pair of opposing side walls 150, 152 connected to the flat upward-facing wall 124. Ribs 154 may be connected between the flat upward-facing wall 124 and the pair of opposing side walls 150, 152 within the rectangular profile. The ribs 154 are shown as angular ribs, perhaps forming a series of "X" patterns, that strengthen the elongate bar against bowing or twisting. However, the ribs 154 may take other forms, such as individual ribs extending directly from one side wall 150 to the other side wall 152.

The intermediate section 116 has a circular arced profile formed by a curved upward-facing wall 126 that extends across a width of the intermediate section for receiving and supporting a hook of a clothes hanger. However, curved upward-facing wall 126 (facing down in FIG. 5B) may, as shown, be semicircular and form generally opposing sidewalls 160, 162. Accordingly, ribs 164 extend along a concave inner surface of the curved upward-facing wall 126. For example, the ribs 164 may be connected to the concave inner surface of the curved upward-facing wall 126, and span between the generally opposing sidewalls 160, 162. The ribs 164 are shown as angular ribs, perhaps forming a series of "X" patterns, that strengthen the elongate bar against bowing or twisting. However, the ribs 164 may take other forms, such as individual ribs extending directly from one side wall 160 to the other side wall 162.

The proximal section 118 has the upward-facing surface 128 (facing down in FIG. 5B) that extends radially outward beyond at least a portion of the curved upward-facing wall 126 of the intermediate section 116. Optionally, the proximal section 118 may have a rectangular profile like that of the distal section 114 and may include ribs 174 connected between opposing side walls 170, 172.

The repositionable closet bar 110 further includes the downward-directed seat 180 configured to engage an upward-facing surface of the closet rod when the flat upward-facing wall 124 of the distal section 114 engages the bottom surface of the closet shelf. In FIG. 5B, the downward-directed seat 180 is a collection of surfaces lying in a plane. The collection of surfaces may include some of the downward-directed surfaces of the opposing side walls 150, 152 and ribs 154 of the distal section 114. The collection of surfaces may further include some of the downward-directed surfaces of the opposing side walls 160, 162 and ribs 164 of the intermediate section 116. The second compressible gripping pad 34 may be adhesively secured to the collection of surfaces that make up the downward-directed seat 180.

Figure 6A:
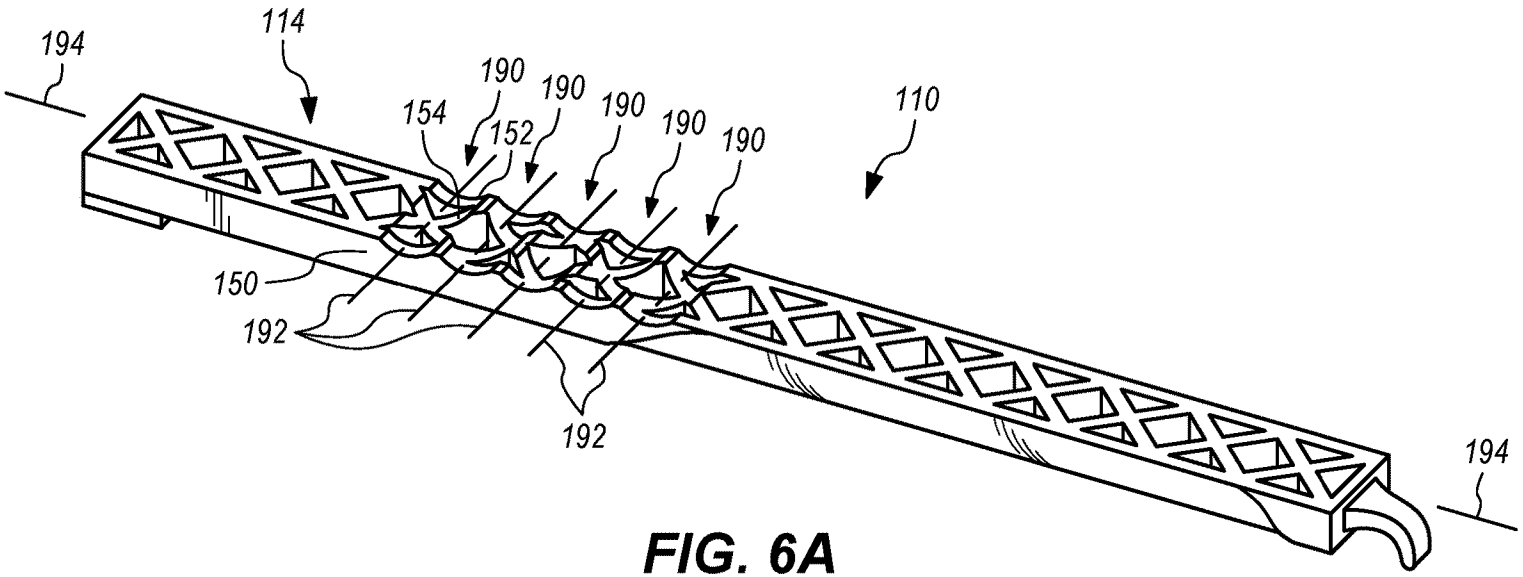
FIGS. 6A-B are bottom perspective views of the repositionable closet bar of FIG. 5A including a series of circular arced seats for engaging a top surface of a standard closet bar.

FIG. 6A is a bottom perspective view of the repositionable closet bar 110 of FIG. 5A including a series of circular arced seats 190 (five shown) for engaging a top surface of a standard closet bar. Each circular arced seat 190 includes one or more surfaces along a concave arc having an axis 192 that is perpendicular to a longitudinal axis 194 of the elongate rigid bar and parallel to a plane of the flat upward-facing wall of the distal section. The one or more surfaces of each seat 190 includes the pair of opposing side walls 150, 152 in the distal section 114 and may further include one or more of the ribs 154 in the distal section 114. Preferably, each seat 190 may have a radius that is approximately the same as a radius of the closet rod.

Figure 6B:
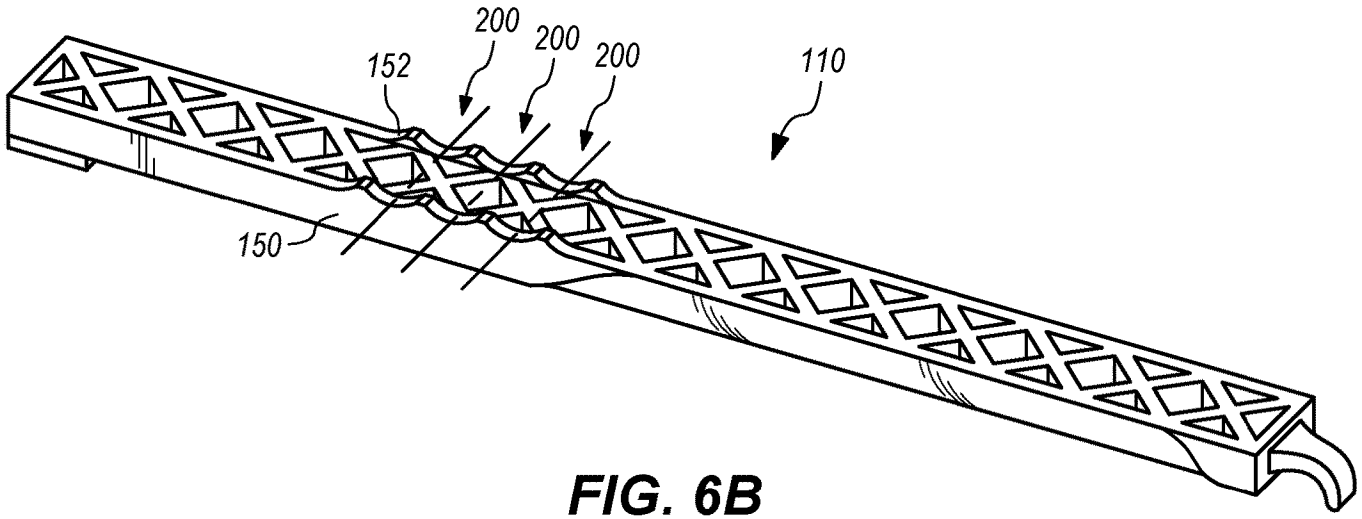

FIG. 6B is a bottom perspective view of a repositionable closet bar forming a series of circular arced seats 200 (three shown) for engaging a top surface of a standard closet bar. The seats 200 are similar to those of FIG. 6A, except that the seats 200 are formed by extending the opposing side walls 150, 152 downward (upward in FIG. 6B). The three circular arced seats 200 provide three different positions where the repositionable closet bar 110 may engage a standard closet rod.

Figure 7:
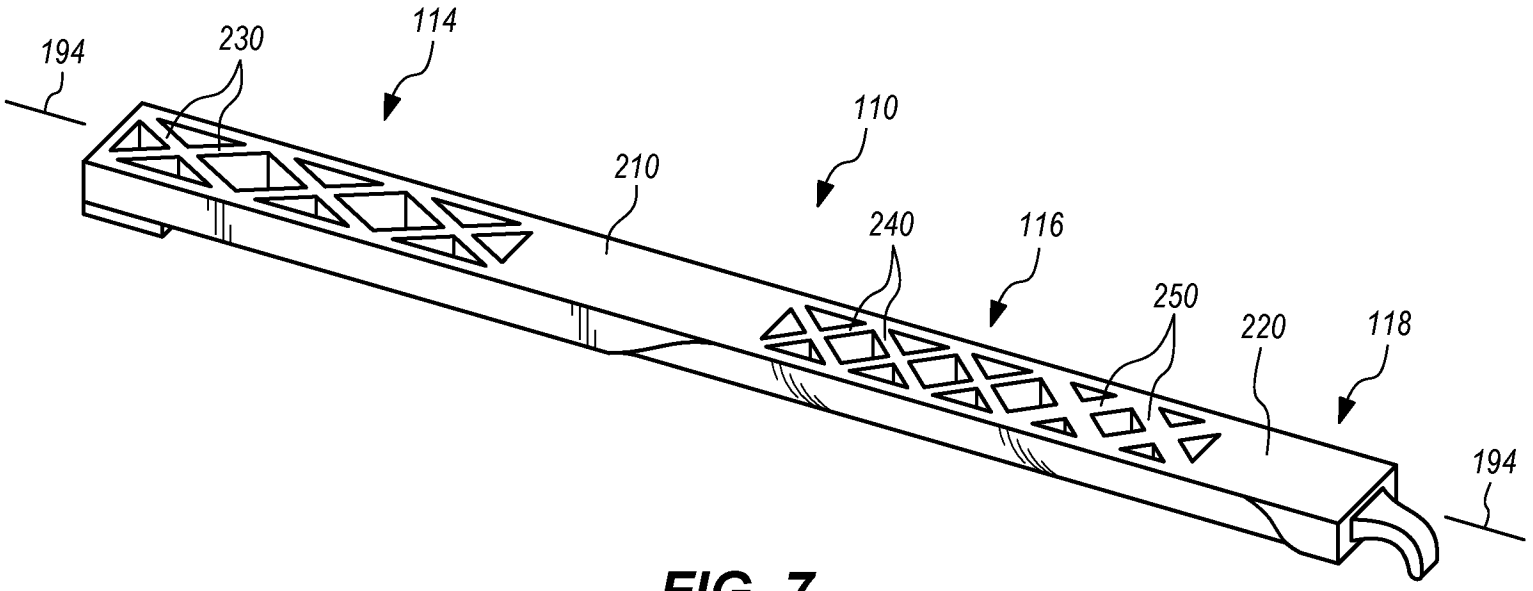
FIG. 7 are bottom perspective view of the repositionable closet bar of FIG. 5A including a series of circular arced seats for engaging a top surface of a standard closet bar.

FIG. 7 is a bottom perspective view of the repositionable closet bar 110 of FIG. 5A including a first flat area 210 forming a downward-directed seat suitable for securing a gripping material or pad that may engage a top surface of a standard closet bar. The repositionable closet bar 110 also includes a second flat area 220, which may be provided for the purpose of adding weight to the proximal end 118. Still further, there are three variations of ribs show in FIG. 5A. The distal section 114 has ribs 230 that use less material per unit of length along a longitudinal axis 194 of the elongate rigid bar than the one or more ribs 240 in the intermediate section and/or the proximal section. A repositionable closet bar that has more weight forward (proximal direction) of a point of engagement with the closet rod than in back (distal direction) of the point of engagement will be stable in an operable position even without having any hangers or other items hanging from the intermediate section or hook. Furthermore, a portion of the intermediate section 116 has ribs 250 that are thicker that the other ribs 230, 240 to increase the weight in the intermediate section.

Figure 8A:
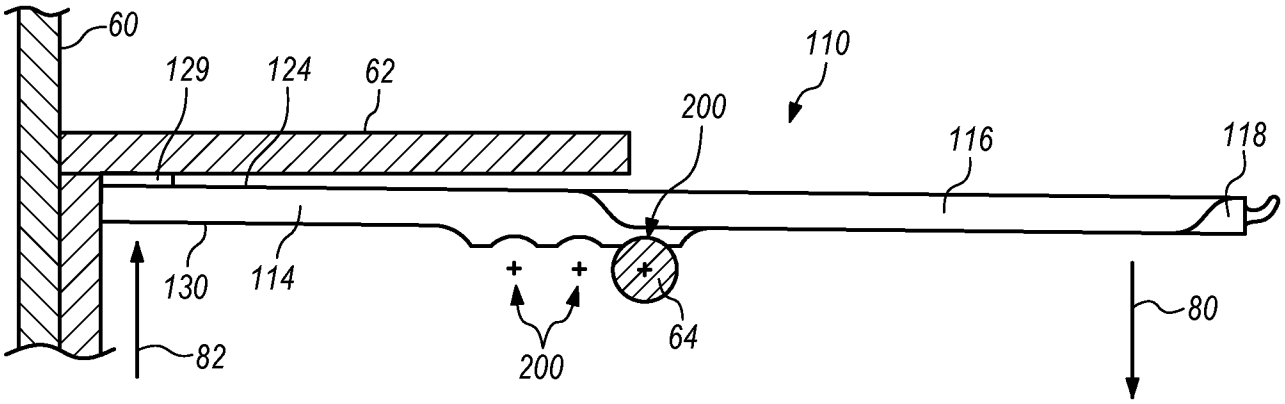
FIGS. 8A-B are side views of the repositionable closet bar including the series of circular arced seats of FIG. 6B in first and second operative positions relative to the standard closet shelf and closet rod combination.
Figure 8B:
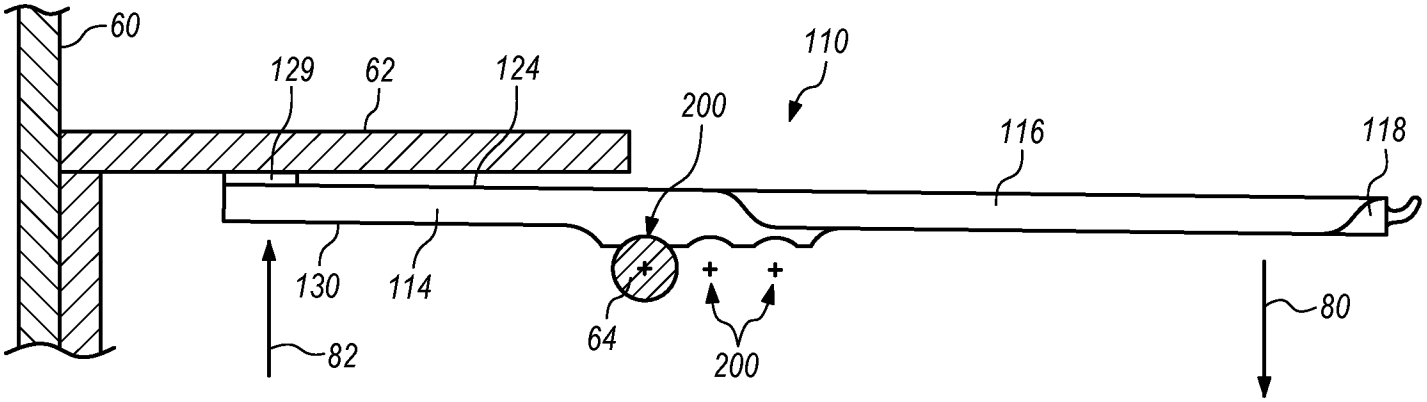

FIGS. 8A-B are side views of the repositionable closet bar including the series of circular arced seats 200 of FIG. 6B (three seats 200 shown) in first and second operative positions relative to the standard closet shelf 62 and closet rod 64 combination (see also FIG. 2). In FIG. 8A, the repositionable closet bar 110 has been positioned with the forward-most of the three seats 200 engaging the closet rod 64. Notice that the seat 200 has an arc radius that matches the radius of the closet rod 64 and engages the surface of the closet rod 64 along a nearly 120-degree arc. In FIG. 8B, the repositionable closet bar 110 has been positioned with the rearward-most of the three seats 200 engaging the closet rod 64. Again, the seat 200 has an arc radius that matches the radius of the closet rod 64 and engages the surface of the closet rod 64 along a nearly 120-degree arc. However, in FIG. 8A, the repositionable closet bar 110 extends further forward of the closet rod 64 to create additional hanging space beyond the space for hanging clothes from the closet rod. Note that the series of seats 200 does not prevent the repositionable closet bar 110 from being positioned between the closet shelf 62 and the closet rod 64 and does not prevent the repositionable closet bar 110 from being repositioned side-to-side between the closet shelf and the closet rod. Furthermore, the repositionable closet bar 110 may be repositioned in a forward direction or a rearward direction in three increments defined by the three seats 200.

The terminology used herein is for the purpose of describing particular embodiments only and is not intended to limit the scope of the claims. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the embodiment.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

What is claimed is:

1. A repositionable closet bar for hanging clothes, comprising:

an elongate rigid bar having a distal section, a proximal section, an intermediate section between the distal section and the proximal section, and a downward-directed seat;

wherein the distal section has a rectangular profile formed by a flat upward-facing wall for engaging a bottom surface of a closet shelf, a pair of opposing side walls connected to the flat upward-facing wall, and one or more ribs extending between a bottom surface of the flat upward-facing wall and the pair of opposing side walls within the rectangular profile;

wherein the intermediate section has a circular arced profile formed by a curved upward-facing wall that extends across a width of the intermediate section for receiving and supporting a hook of a clothes hanger and one or more ribs extending along a concave inner surface of the curved upward-facing wall;

wherein the proximal section has an upward-facing surface that extends radially outward beyond at least a portion of the curved upward-facing wall of the intermediate section;

wherein the elongate rigid bar is configured to be positioned between the closet shelf and a closet rod, repositioned side-to-side between the closet shelf and the closet rod, and repositioned in a forward direction or a rearward direction between the closet shelf and the closet rod, and wherein, when in use, no portion of the elongate rigid bar is fastened to the closet shelf and no portion of the elongate rigid bar is fastened to the closet rod; and wherein the downward-directed seat is configured to engage an upward-facing surface of the closet rod when the flat upward-facing wall of the distal section engages the bottom surface of the closet shelf.

2. The repositionable closet bar of claim 1, wherein the downward-directed seat includes one or more surfaces lying in a plane that is parallel to a plane of the flat upward-facing wall of the distal section.

3. The repositionable closet bar of claim 1, wherein the downward-directed seat includes one or more surfaces along a concave arc having an axis that is perpendicular to a longitudinal axis of the elongate rigid bar and parallel to a plane of the flat upward-facing wall of the distal section.

4. The repositionable closet bar of claim 3, wherein the concave arc has a radius that is approximately the same as a radius of the closet rod.

5. The repositionable closet bar of claim 3, wherein the one or more surfaces of the downward-directed seat includes the pair of opposing side walls in the distal section.

6. The repositionable closet bar of claim 5, wherein the one or more surfaces of the downward-directed seat further includes at least one of the one or more ribs in the distal section.

7. The repositionable closet bar of claim 5, wherein the downward-directed seat is included in a plurality of identical downward-directed seats.

8. The repositionable closet bar of claim 1, wherein the circular arced profile is a semicircular profile.

9. The repositionable closet bar of claim 1, further comprising:

a compressible gripping material secured to the flat upward-facing wall of the distal section for engaging the bottom surface of the closet shelf.

10. The repositionable closet bar of claim 1, further comprising:

a compressible gripping material secured to the downward-directed seat for engaging the upward-facing surface of the closet rod.

11. The repositionable closet bar of claim 1, wherein the curved upward-facing wall of the intermediate section has a radius from about 0.5 inch to about 0.75 inch, and wherein the elongate rigid bar has a height that is less than about 1.0 inch.

12. The repositionable closet bar of claim 1, wherein at least a portion of the intermediate section is configured to extend forwardly beyond a space for hanging clothes from the closet rod.

13. The repositionable closet bar of claim 1, wherein the elongate rigid bar has a constant width along its length from a proximal end to a distal end.

14. The repositionable closet bar of claim 1, wherein the elongate rigid bar is straight.

15. The repositionable closet bar of claim 1, wherein the elongate rigid bar is made with plastic.

16. The repositionable closet bar of claim 1, wherein the elongate rigid bar has a height from 0.5 to 1.25 inches, a width from 1 to 1.5 inches, and a length from 16 to 32 inches.

17. The repositionable closet bar of claim 1, further comprising:

a hook that extends in a longitudinal direction from a proximal end of the proximal section of the elongate rigid bar.

18. The repositionable closet bar of claim 1, wherein the one or more ribs in the distal section has less material per unit of length along a longitudinal axis of the elongate rigid bar than the one or more ribs in the intermediate section.

* * * * *